United States Patent [19]

Webb

[11] 4,040,358

[45] Aug. 9, 1977

[54] HYDRAULIC DELAYED ARMING FUZE

[75] Inventor: George Webb, Richmond, Ind.

[73] Assignee: Avco Corporation, Wilmington, Mass.

[21] Appl. No.: 513,804

[22] Filed: Dec. 14, 1965

[51] Int. Cl.[2] ..... F42C 15/22; F42C 15/34

[52] U.S. Cl. ..... 102/79; 102/76 P; 102/82

[58] Field of Search ..... 102/79, 82, 80, 76 P

[56] References Cited

U.S. PATENT DOCUMENTS

| | | | |
|---|---|---|---|
| 2,900,908 | 8/1959 | Burrell | 102/79 X |
| 2,962,968 | 12/1960 | Neuwirth et al. | 102/79 X |
| 3,035,521 | 5/1962 | Hynard | 102/79 X |
| 3,112,704 | 12/1963 | Schaadt | 102/79 X |
| 3,264,995 | 8/1966 | Libby et al. | 102/79 |

FOREIGN PATENT DOCUMENTS

| | | | |
|---|---|---|---|
| 515,211 | 3/1921 | France | 102/79 |

*Primary Examiner*—David H. Brown
*Attorney, Agent, or Firm*—Redfield, Alden D.; Charles M. Hogan

[57] ABSTRACT

The invention is a missile fuze. A slider carries a detonator so that it is normally out of alignment with the firing train. The slider is locked in position by cylinders. The cylinders contain pistons which respond to centrifugal force to move radially outwardly, in each instance moving the center of gravity of each cylinder-piston combination outwardly. When the centrifugal force exerted on such combinations becomes sufficiently great the combinations move outwardly and unlock the slider, which then positions the detonator in alignment with the firing train. In order to be displaced radially outwardly the cylinders must overcome the force of retainer weights which are mounted and proportioned in such manner as to respond to centrifugal force and spin to increase the retaining thrusts.

7 Claims, 3 Drawing Figures

INVENTOR.
GEORGE WEBB
BY Alden W. Redfield
Charles M. Hogan
ATTORNEYS.

HYDRAULIC DELAYED ARMING FUZE

The present invention relates to fuzes for installation in missiles.

The principal object of the invention is to provide an improved fuze including automatic means, responsive to centrifugal forces developed during spin, for arming an explosive missile.

Figure 1:
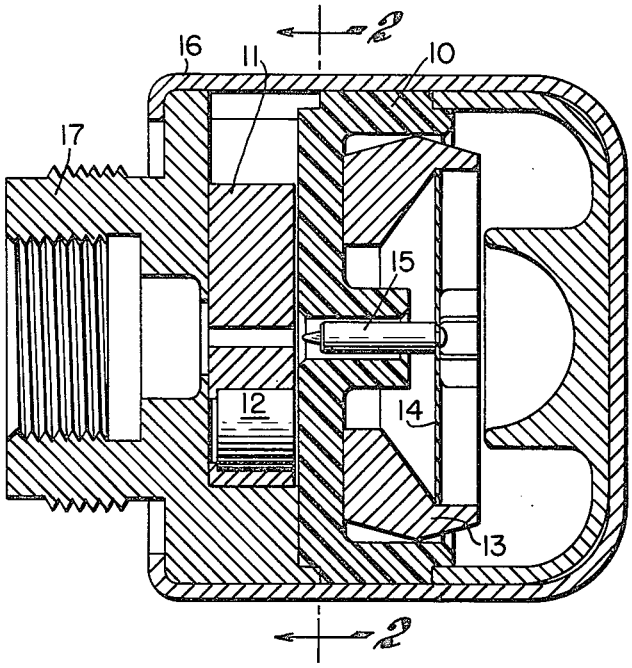
Figure 2:
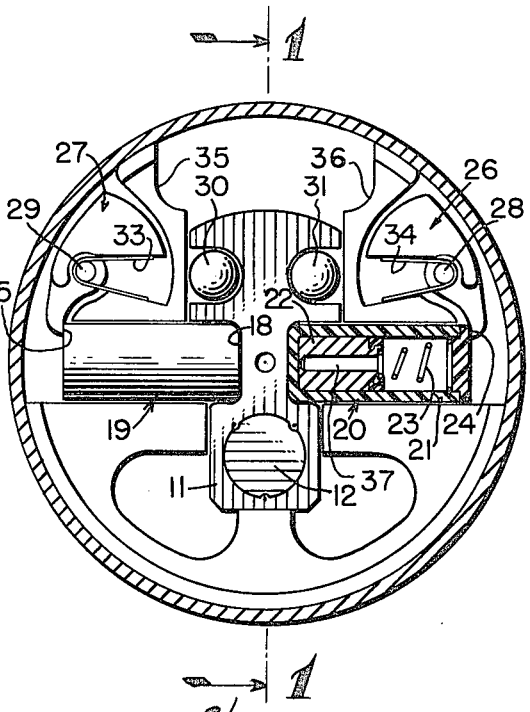
Figure 3:
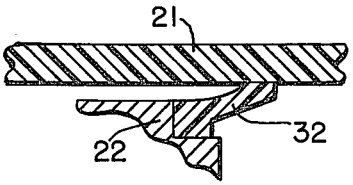

For a better understanding of the invention, together with other and further objects, advantages, and capabilities thereof, reference is made to the following description of the appended drawings, in which:

FIG. 1 is an axial sectional view as taken along line 1—1 of FIG. 2, showing an improved fuze in accordance with the invention, and FIG,. 2 is a sectional view as taken along section line 2—2 of FIG. 1, in each case looking in the direction of the arrows, and FIG. 3 is a detailed sectional view of a portion of one of the locking means, featuring the seal.

Attention is first invited to an aluminum slider or detonator-carrier device 11. Mounted on the carrier 11 and adapted to be positioned thereby is a detonator or primer 12. Suitably mounted with respect to a brass inertia weight 13, as by a spring 14, is a centrally disposed axially oriented firing pin 15. The weight 13 is positioned in a plastic housing 10.

When the fuze is unarmed, the positional relationship between the detonator 12 and the firing pin 15 is that of misalignment, precluding firing. The present invention concerns itself with the means by which this position is maintained and the means by which the detonator 12 is brought into registry with respect to the firing pin and centrality with respect to the fuze as a whole when the armed condition is assumed.

Parenthetically, the entire fuze assembly is enclosed by a cover 16, which cover is secured to a fitting 17, and the fitting is threaded onto a conventional booster (not shown).

The detonator carrier is maintained in "safe" position by reason of the engagement of locking means with locking surfaces such as that numbered 18, formed on each side of the carrier 11. These locking means are numbered 19 and 20, and each comprises a nylon cylinder such as 21, a brass piston such as 22 slidably mounted within the cylinder, and a biasing spring 23 secured within the cylinder in such manner as to bias the piston radially inwardly. That is to say, each locking means comprises a subassembly including a piston and a biasing spring and a cylinder.

Centrifugal forces develop during spin of the missle in which the fuze is installed, causing the piston to move radially outwardly, thereby increasing the moments of inertia of the assemblies housed within the cylinders for elements 19 and 20 referred to the axis of the fuze. The locking means are initially mechanically restrained in their radially inward positions by reason of thrust exerted by the forward surfaces 24 and 25 of a pair of swingably mounted brass retaining weights or dogs 26 and 27, these being mounted on pivots 28 and 29, respectively.

In response to centrifugal forces developed during spin, the center of gravity of the retaining weight 26 is located in such manner that the turning moment with respect to pivot 28 tends to turn retainer 26 clockwise. The turning moment of the center of gravity of retainer 27 with respect to pivot 29 is such that retainer 27 tends to turn counterclockwise. In both cases the thrust exerted by the retaining weights urges the locking means radially inwardly. However centrifugal forces acting on the piston urge the pistons such as 22 radially outwardly, and as the pistons move to the outer ends of the cylinders the increased outward pressures of the locking means overcomes the retaining forces, causing retainers 26 and 27 to turn counterclockwise and clockwise, respectively, thereby freeing the entire locking means for outward radial movement, whereby the detonator carrier 11, as by centrifugal force, spring or the like (not shown), is linearly displaced in such a manner as to align the detonator 12 with the firing pin 15. The detonator may then be locked in the position of alignment as by floating locking balls 30 and 31 cooperating with conventional detent surfaces 35 and 36. Note is made that the dogs 26 and 27 are normally yieldably biased clockwise and counterclockwise, respectively, by springs 33 and 34, into the FIG. 2 position.

Each of the pistons is provided with an annular seal or ring such as 32, shown in section in FIG. 3, and each cylinder is partially filled with a non-compressible liquid. As shown in FIG. 3, each seal, such as 32, is formed so that it diverges outwardly from the associated piston, such as 22, into contact with the inner surface of the associated cylinder such as 21. As each piston is forced into the liquid by the centrifugal force developed during spin, the non-compressible fluid is forced radially inwardly through the small orifice 37 centrally located in the piston. The spin rate and the flight distance consumed in arming being predetermined, the time of liquid discharge and the proportions of the retainers and the locking means are, with the teachings of this specification before them, within the competence of those of ordinary skill in this art.

The invention offers these advantages: improved accuracy in arming distance; simplified construction; relative freedom from environmental changes; and general utility, including utilization with missiles of very small diameter. Additionally, for a given rifling, the arming distance will be subtantially constant, regardless of projectile velocity. An increased linear velocity will in turn increase the spin increased linear velocity will in turn increase the spin velocity, resulting in shorter arming time, thereby counteracting the effect of the higher linear velocity in so far as the arming distance is concerned.

From the foregoing, it will be seen that the invention comprises, in a fuze of the type adapted to be installed in a missile, the combination of: firing means 15; a displaceable element 11 having a normal disabling positional relationship with reference to the firing means but adapted to be displaced to an enabling positional relationship, said displaceable element being formed with locking surfaces; a plurality of locking means 19, 20, each comprising a partially fluid-filled hollow cylinder 21 and a hydraulic piston 22 slidably mounted within the cylinder and a spring 23 for biasing the piston radially inwardly; and a plurality of pivotally mounted retaining weights 26 and 27 for yieldably holding the locking means in locking position and in engagement with said surfaces, centrifugal force due to spin of the missile in flight moving the retaining weights radially outwardly against the force of the fluid until the thrust exerted by the locking means overcomes the retaining thrust exerted by the retaining weights, whereupon the locking means are disengaged from the displaceable element to permit the displaceable element to move to its enabling position with respect to the firing means.

While there has been shown and described what is at present considered to be the preferred embodiment of the invention, it will be understood by those skilled in the art that various modifications and changes may be made therein without departing from the true scope of the invention as defined by the appended claims.

I claim:

1. In a fuze of the type adapted to be installed in a missile, the combination of:

firing means, a displaceable element having a normal disabling positional relationship with reference to the firing means but adapted to be displaced to an enabling positional relationship, said displaceable element being formed with locking surfaces, a plurality of locking means each comprising a partially fluid-filled hollow cylinder, a hydraulic piston, formed with a timing orifice and slidably mounted within the cylinder, and a spring for biasing the piston radially inwardly, and a plurality of retainer weights for yieldably holding the cylinders in locking position and in engagement with said surfaces, said retainer weights being pivotally mounted and proportioned to exert increased retaining force on the cylinders as centrifugal force increases, centrifugal force due to spin of the missile in flight moving the pistons radially outwardly against the force of the fluid until the thrust exerted by the cylinders overcomes the retaining thrust exerted by the retainers whereupon the cylinders are disengaged from the displaceable element to permit the displaceable element to move to its enabling position with respect to the firing means.

2. In a fuze the combination in accordance with claim 1 in which the firing means is a firing pin and in which the displaceable element is a detonator carrier which when displaced to its enabling positional relationship aligns the detonator with the firing pin.

3. In a fuze the combination in accordance with claim 2 and spring means for normally biasing the retainer weights into retaining position.

4. In a fuze the combination in accordance with claim 3 in which the detonator carrier is mounted for linear slidable movement.

5. In a fuze the combination in accordance with claim 4 in which the retaining weights are formed with weight portions on one side of their pivots and thrust portions on the other side of their pivots, which thrust portions exert thrust against the cylinders.

6. In a fuze the combination in accordance with claim 5 in which each piston is provided with an annular seal.

7. In a fuze the combination in accordance with claim 6 in which each annular seal diverges outwardly into contact with the inner surface of its associated cylinder.

* * * * *

UNITED STATES PATENT AND TRADEMARK OFFICE

CERTIFICATE OF CORRECTION

PATENT NO. : 4,040,358

DATED : August 9, 1977

INVENTOR(S) : George Webb

It is certified that error appears in the above-identified patent and that said Letters Patent are hereby corrected as shown below:

Column 2, line 3, please change "piston" to ---pistons---.

Column 2, line 42, please delete "increase the spin increased linear velocity will in turn"

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*